US006199327B1

(12) United States Patent
Krawczyk

(10) Patent No.: US 6,199,327 B1
(45) Date of Patent: Mar. 13, 2001

(54) MEMORIAL PLAQUE WITH REMOVABLE MARKER BLOCK

(76) Inventor: Andrew Krawczyk, 50 Prince Andrew Pl., Toronto, Ontario (CA), M3C 2H4

( * ) Notice: Subject to any disclaimer, the term of this patent is extended or adjusted under 35 U.S.C. 154(b) by 0 days.

(21) Appl. No.: 09/234,280

(22) Filed: Jan. 19, 1999

(51) Int. Cl.[7] ..... E01F 9/011

(52) U.S. Cl. ..... 52/104; 52/103; 40/124.5; 40/781

(58) Field of Search ..... 52/103, 104; 40/124.5, 40/781

(56) References Cited

U.S. PATENT DOCUMENTS

| | | | |
|---|---|---|---|
| 215,457 | 5/1879 | Jackson . | |
| 291,106 | 1/1884 | Strong . | |
| 2,016,382 | 10/1935 | McBurney . | |
| 2,095,290 | 10/1937 | Roy . | |
| 2,586,178 | 2/1952 | Rochester . | |
| 3,481,089 | 12/1969 | Sheidow . | |
| 4,019,298 | 4/1977 | Johnson, IV . | |
| 4,202,144 | 5/1980 | Patterson . | |
| 5,014,472 | 5/1991 | Svensson . | |
| 5,563,766 | 10/1996 | Long et al. . | |
| 6,006,458 * | 12/1999 | Weiss | 40/124.5 |

* cited by examiner

*Primary Examiner*—Carl D. Friedman
*Assistant Examiner*—Christy M. Syres
(74) *Attorney, Agent, or Firm*—Wolf, Greenfield & sacks, P.C.

(57) ABSTRACT

The invention provides a memorial plaque adapted for detachable mounting to a forward surface of a base, such as a cover slab of a crypt, a headstone or grave marker. The plaque includes a marker block having an exposed face adapted to receive memorial indicia and a hollow back frame having a front wall with peripheral rearwardly extending side walls. The peripheral side walls have a back edge with profile mating the forward surface of the base thus defining a rearwardly open cavity between the base and front wall laterally bounded by the side walls. The close fitting of the frame protects the marker block from weather damage and vandalism. The marker block is releasably secured to the frame within the cavity with its exposed face adjacent a window in the front wall of the frame. Mounting brackets can be housed entirely within the cavity or hidden from view under removable ornaments to releasably mount the frame to the base. This enables the rapid removal of the blank marker block and replacement after memorial indicia have been applied. Preferably the marker block is a stone slab with a polished exposed face that can be quickly marked with conventional sandblast methods. Alternatively, the blank marker block can be replaced with a previously completed block including any desired type of indicia. Mounting brackets for example can include a top bracket mounted adjacent an upper frame side wall, with a plate with connecting fasteners for securing the plate to the base. The plate may have an upper edge adapted to suspend the frame on the bracket. A locking device disposed on a lower frame side wall and on the lower end of the plate, releasably locks the plate and frame together. Optionally an externally mounted ornament can be secured to an outer surface of a wall of the frame with a fastener extending through said wall from the cavity, and for visual effect and secure mounting the outer surface of said wall includes a mating socket in which the ornament is disposed. Also optionally the plaque may include an auxiliary block having an exposed face adapted to receive memorial indicia, with the auxiliary block releasably secured to the frame within the cavity with its exposed face adjacent an auxiliary window in the front wall of the frame.

16 Claims, 4 Drawing Sheets

MEMORIAL PLAQUE WITH REMOVABLE MARKER BLOCK

TECHNICAL FIELD

The invention is directed to a memorial plaque for mounting to a crypt, headstone or grave marker, with a removable marker block adapted for rapid installation of indicia.

BACKGROUND OF THE ART

Memorial plaques with names, dates and other indicia embedded on them are widely used in marking grave sites, tombstones and crypts. Such plaques are usually left outdoors and are intended to be very long lasting, if not permanent. Memorial markers and plaques as a result are designed of very robust materials, such as cast metal and stone that resist weather damage and vandalism. To provide permanence and resistance to damage, the markers or plaques are often constructed in a manner where components are permanently attached together, or where it is extremely difficult to remove components.

For example, in many cases a solid stone marker or head stone is engraved with the memorial indicia. Cast letters or numbers are permanently attached to a stone slab or a cast metal plaque is manufactured with all required lettering cast or engraved in a permanent manner.

The cost and time taken to prepare such memorial markers and plaques are considerable. For example, in the case of an engraved stone slab, due to shipping, manufacturing, and scheduling, the time between ordering and completely installing the received marker may be in the order of six to eight weeks. Due to the skilled labour and cost of shipping and installation, the total cost of preparing and installing the marker is considerable.

Recent trends indicate a customer desire toward simplifying funeral services, and movement in favour of cremation and burial in crypts. This reflects a desire to reduce the cost and complexity of traditional funeral services. Of particular relevance to the present invention are the cost and delay inherent in the labour intensive of preparation of an appropriate grave marker or crypt plaque.

In addition to the relatively high cost, the delay involved in preparing and installing a memorial plaque marker is becoming unacceptable to contemporary purchasers. Since the name and date of birth with date of death are commonly marked on the memorial plaques, for obvious reasons, it is impossible to complete the preparation of markers in advance. It is common practice for married couples or entire families to be buried together in a crypt and in such cases, the memorial plaques or markers may be modified a number of times.

However, if possible, it is preferred to conduct burial services when the site is fully marked, as opposed to an unmarked or partially completed site. The participants in the service perceive such preparation as more respectful and completed markings eliminate any concern that mistakes may occur later in finalizing the site marking.

There is a market demand for relatively lower cost marking of grave sites that involve less time delay and permit changes to be made to markers over multiple graves. Traditionally, purchasers have resisted conformity and prefer a wide choice of ornamental features in memorial markers.

The prior art has introduced several memorial markers with removable or replaceable indicia in response to this demand. For example, U.S. Pat. No. 3,481,089 to Sheidow provides a cast memorial marker with removable plates that can be interchanged in order to provide flexibility in inserting names and dates, etc. The removable plates with indicia can be permanently attached when desired on final installation.

Another example is provided in U.S. Pat. No. 2,586,178 to Rochester which includes a removable blank plate which is replaced with an engraved plate on the forward face of a grave marker. In the case of Rochester, the plate is attached by embedding in wet concrete, whereas in U.S. Pat. No. 5,014,472 to Svensson a sliding tongue and groove system is used to attach an engraved name plate.

The prior art suffers from the disadvantage that uniformity is required in the design of the grave markers, and very little flexibility is provided in the choice of marker shape and additional ornamental features which may be added to include unique aspects. Customers will consider inappropriate any marker which appears to be mass produced and substantially identical to adjacent markers of others.

The prior art provides little design flexibility in use of different materials together, such as stone and castings of metal. In addition, the prior art does not balance well the desire for permanence with the need for periodic repair or maintenance in the event of damage.

The significant disadvantage of the prior art is that the final installation requires relatively high level skills and specialized tools. It is highly desirable however, for cemetaries with relatively unskilled labour and few specialized tools to perform all necessary installation and marking themselves. In this manner, the cost and delay in completing the installation is reduced considerably.

Once persons from outside the cemetary grounds must travel to the cemetary or the markers must be shipped from the cemetary to a manufacturing plant, such operations involve significant delay and cost especially in the case where heavy stone and cast metal components are used. In many cases cemetaries are located outside highly populated areas in relatively isolated park like settings. The logistics of transporting materials or skilled labour between cemetaries involves significant travel for persons and freight costs for materials and equipment.

Therefore, it is desirable to provide a relatively low cost marker which can be rapidly modified to include marking indicia without the need for specialized tools or skilled labour apart from those employed by a cemetary.

It is also desirable to provide a marker, which has relatively permanent means to mount the marker to resist damage while at the same time being easily removable if changes or maintenance are required.

It is also highly desirable to provide a marker which allows a significant degree of modification and preferably combines the use of traditionally used materials such as stone and cast metal to respond to the market demand for unique or individual combinations of ornamental features.

DISCLOSURE OF THE INVENTION

The invention provides a novel memorial plaque adapted for detachable mounting to a forward surface of a base, such as a cover slab of a crypt, a headstone or grave marker.

The plaque includes a marker block having an exposed face adapted to receive memorial indicia and a hollow back frame having a front wall with peripheral rearwardly extending side walls. The peripheral side walls have a back edge with profile mating the forward surface of the base thus defining a rearwardly open cavity between the base and front wall laterally bounded by the side walls. The close fitting of the frame protects the marker block from weather damage and vandalism.

The marker block is releasably secured to the frame within the cavity with its exposed face adjacent a window in the front wall of the frame. Mounting brackets protectively housed entirely within the cavity releasably mount the frame to the base. This enables the rapid removal of the blank marker block and replacement after memorial indicia have been applied.

Preferably the marker block is a stone slab with a polished exposed face that can be quickly marked with conventional sandblast methods. Alternatively, the blank marker block can be replaced with a previously completed block including any desired type of indicia. Mounting brackets for example can include a top bracket mounted adjacent an upper frame side wall, with a plate with connecting fasteners for securing the plate to the base. The plate may have an upper edge adapted to suspend the frame on the bracket. A locking device disposed on a lower frame side wall and on the lower end of the plate, releasably locks the plate and frame together.

Optionally externally mounted ornamentation such as auxiliary plaques, sculptures, flower holders etc. can be secured to an outer surface of a wall of the frame with a hidden fastener extending through the wall from the cavity. For visual effect and secure mounting the outer surface of said wall can include a mating socket in which the ornament is fitted.

Also optionally the plaque may include an auxiliary block having an exposed face adapted to receive memorial indicia, with the auxiliary block releasably secured to the frame within the cavity with its exposed face adjacent an auxiliary window in the front wall of the frame.

The invention provides several desirable advantageous over the prior art. By removing a single locking screw the covering frame can be released. Access to the marker block secured to the back of the frame is very simple. The marker block is removed and memorial indicia can be installed on the polished exposed face. An extremely economical method of marking is to construct the marker block as a polished stone with rough cut edges except for the exposed polished face. After removal, the memorial indicia can be applied to the polished face by conventional sand blasting techniques wherein a mask is applied to the polished face and sand blasting is used to scour the polished face, thereby marking names, dates, etc. The marker block can be quickly reassembled to the frame and the frame hung back on the base with a minimum of delay.

Conventional means of marking plaques often involve delays of a number of days or weeks before engraving or properly mounted plaques are completed. The invention provides a means of removing, marking and replacing the marker block in a matter of hours with presently available equipment and a minimum of skill. The amount of lead time required to complete the marking operation is significantly reduced over conventional systems.

The design of the plaque and marker are very flexible and various types of modifications can be made simply without requiring different means to connect the frame to the base. A common mounting bracket can be used for a number of different frame and block shapes. Standard spacing and size of anchoring bolts in the base can be provided.

The outer shape of the frame, the number of windows and marker blocks, the inclusion of inserts or bolted on sculptural features, cups, candle holders, flower holders, can be readily provided with hidden fasteners covered by the frame. Not only does hiding the fasteners provide aesthetic appeal, but as well, prevents vandalism and tampering. The complete enclosure of the marker block prevents vandalism and reduces the cost of the block preparation since only the exposed fee needs to be polished. The back and sides of the marker block can be left in their rough cut shape.

Further details of the invention and its advantages will be apparent from the detailed description and drawings included below.

BRIEF DESCRIPTION OF THE DRAWINGS

In order that the invention may be readily understood, three preferred embodiments of the invention will be described by way of example, with reference to the accompanying drawings wherein.

DETAILED DESCRIPTION OF PREFERRED EMBODIMENTS

Figure 1:
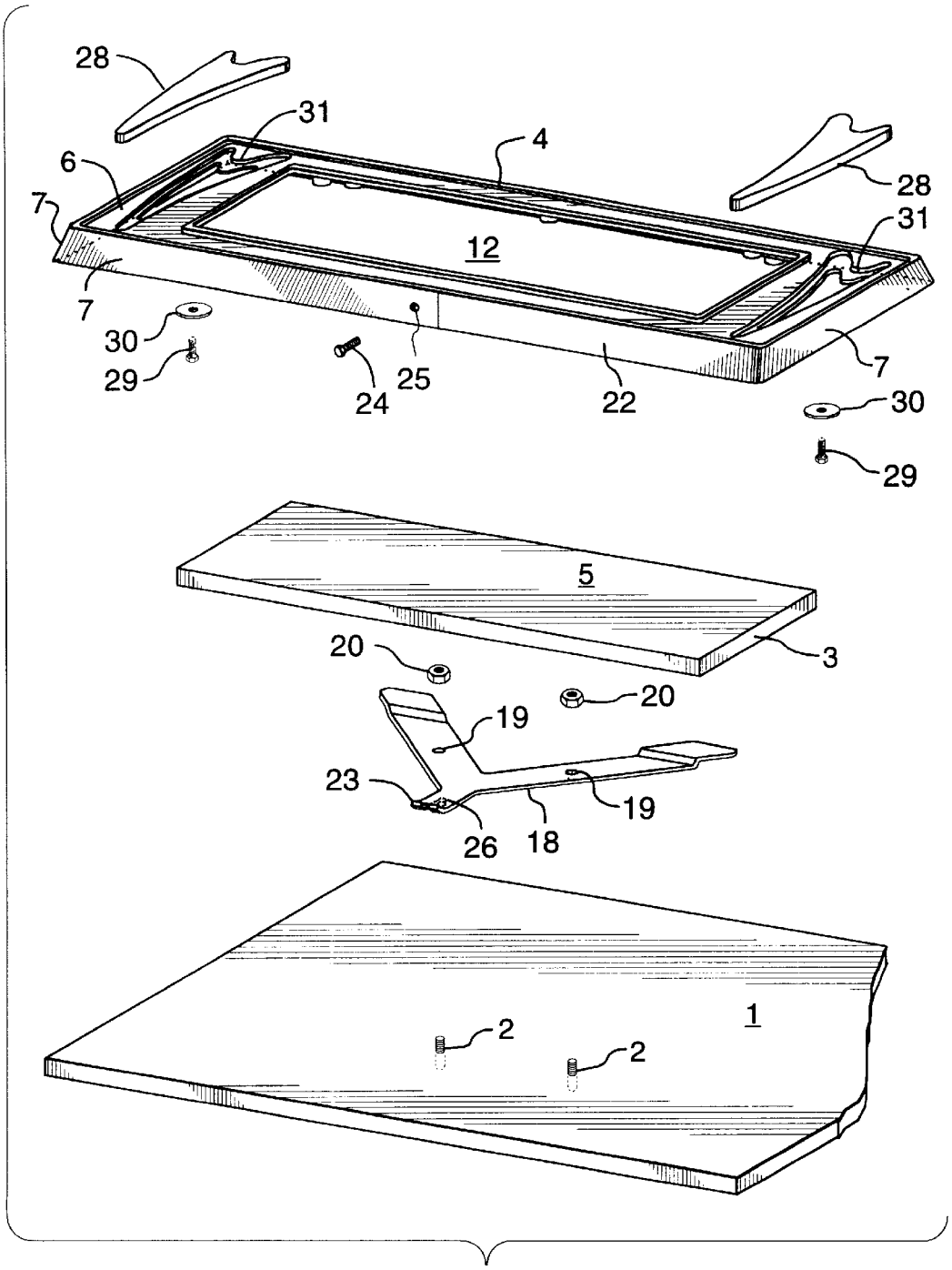
FIG. 1 is an exploded perspective view of the memorial plaque adapted for detachable mounting on bolts extending from a forward surface of a flat base, the memorial plaque includes a hollow back frame with a centrally located window through which the exposed face of a marker block is visible and adapted to receive memorial indicia, together with mounting means in a form of a Y-shaped flat plate.

As illustrated in FIG. 1, the invention provides a memorial plaque which is adapted for detachable mounting to a forward surface of a base 1. The base may be any conventional burial structure, such as for example, the front plate of crypt, a traditional headstone, or a flush ground level grave marker plate. The base 1 includes two anchor bolts 2 upon which the memorial plaque is secured to the base 1.

The plaque in the preferred embodiment illustrated in the drawings is a composite of a stone marker block 3 and a hollow back metal cast frame 4. This combination of highly damage resistant traditional materials is preferred since the appearance of stone is generally preferred by purchasers, the strength and damage resistance of cast metal components is superior and one can easily add decorative features. It will be apparent however, that the marker block 3 can be a constructed of any material which can be designed with an exposed face 5 adapted to receive memorial indicia. For example, if desired, the marker block 3 can be a cast metal plate with memorial indicia cast or engraved in the exposed face 5. However, this type of construction would involve relatively higher expense and more time delay than a sand blasted stone marker block 3.

The hollow back frame 4 completely surrounds and protects the marker block 3. As well, the hollow back frame 4 conceals all connecting means for a clean outward appearance which does not expose connectors to vandalism or corrosion. The hollow back frame 4 has a front wall 6 with peripheral rearwardly extending side walls 7. It will be understood that in the example shown, the frame 4 is rectangular shaped with four peripheral side walls 7. However, the frame 4 and marker blocks 3 can be constructed in any outward shape desired with any number of curved or straight side walls 7. For example, as shown in the alternative embodiment of FIG. 3, independent design of the outward shape and decorative features is a significant advantage of this invention. The means for mounting the memorial plaque to the base 1 are independent of the outward shape of the frame 4 and independent of the shape and number of marker blocks 3. As a result, a uniform base 1 with standard anchor bolts 2 can be utilized in association with any number of outwardly appearing frame 4 and marker blocks 3.

Figure 2:
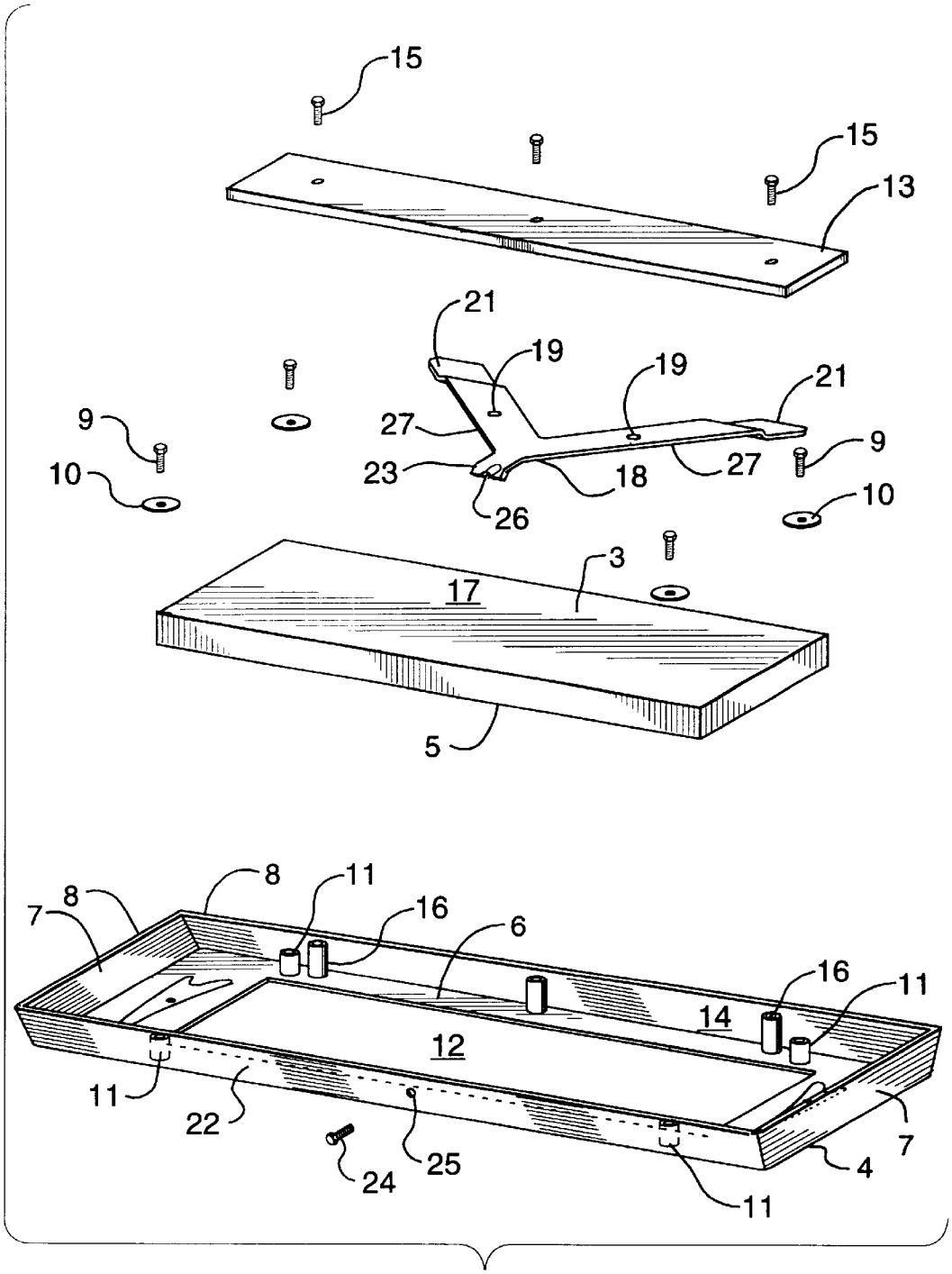
FIG. 2 is a like exploded perspective view of the memorial plaque from the rear side showing the hollow back of the frame with upstanding lugs to receive the screws which hold the marker block and bracket in place.

As best indicated in FIG. 2, the peripheral side walls 7 have a back edge 8 with a profile to mate the forward surface of the base 1. In the embodiment illustrated, the base 1 is planar and therefore, the back edge 8 defines a planar surface closely fitting the surface of the base 1 to prevent weather or vandalism damage. For example, if the base 1 is a curved structure, the frame 4 and or the back edge 8 can also be curved to suit such a configuration.

The combination of front face 6 and surrounding peripheral side walls 7 defines a rearwardly open cavity (as best seen in FIG. 2) between the base 1 and front wall 6, laterally bounded by the side wall 7. The marker block 3 is releasably secured with screws 9 and washers 10 in threaded lugs 11 cast together with the frame 4. The result is that the block 3 secured to the frame 4 within the cavity with it exposed face 5 immediately adjacent a window 12 in the front wall 6 of the frame 4.

With the block 3 secured in the frame 4, all connectors 9 and 10 are hidden within the cavity. The combined frame 4 and block 3 are releasably mounted to the base 1 with mounting means described below that are connected to the frame 4 and entirely housed within the cavity of the frame 4.

As best seen in FIG. 2, the mounting means include a bracket 13 which is mounted adjacent an upper frame side wall 14 with screws 15 inserted into lugs 16 also cast together with the frame 4. The height of the lugs 16 is chosen such that the position of the bracket 13 is spaced a selected distance away from the rear face 17 of the marker block 3. This spacing allows for the sliding insertion of the plate 18, between the bracket 13 and the block rear face 17.

The plate 18 includes holes 19 as shown in FIG. 1, which together with nuts 20 and anchor bolts 2 secure the plate 18 to the base 1. Referring to FIG. 2, the plate 18 has a tapered upper edge 21, adapted to suspend the frame 4 on the bracket 13. By sliding insertion of the frame 4 along the surface of the base 1, the upper edge 21 of the plate 18 slides along the rear face 17 of the block 3 and secures the upper edge 21 between the bracket 13 and the rear face 17.

In order to lock the frame 4 and attached marker block 3 in the desired position, locking means are disposed on the lower frame side wall 22 and on the lower end 23 of the plate 18 for releasably locking the plate 18 and frame 4 together. In the embodiment illustrated, the locking means comprise a set screw 24 threaded into a hole 25 in the frame 4. In the lower end 23 of the plate 18, is a receiving scallop 26 preferred with a tapered surface to provide a wedging or clamping action when the set screw 24 is screwed in the threaded hole 25.

Advantageously the height of the side walls 7 is greater than the thickness of the marker block 3 in order that the mounting plate 18 and bracket 13 can be disposed rearward of the marker block 3. In this manner, the length and width of the frame 4 can be minimized if desired. In addition, the provision of a single set screw 24 is permitted by use of the simple mounting plate 18 having only three points of connection with the frame 4. The plate 18 has two upper arms 27 in order to suspend the plate 4 from the bracket 13 on two points thereby simplifying placement. The frame 4 will not rock when secured at three points.

Referring to FIG. 1, various types of externally mounted ornaments 28 may be secured to the outersurface of the front wall 6 or side walls 7 of the frame with fasteners 29 and 30 extending through the wall from inside the cavity. For aesthetic appeal and secure mounting, the outer surface of the front wall 6 can include a mating socket 31 in which the ornament 28 is fitted. For example, some purchaser may desire different sculptural features, candle holders, flower holders, or such ornaments. The provision of a hollow back frame 4 allows for fastening of these ornamental features in a manner which is resistant to vandalism and hides the connectors 29 and 30.

Figure 3:
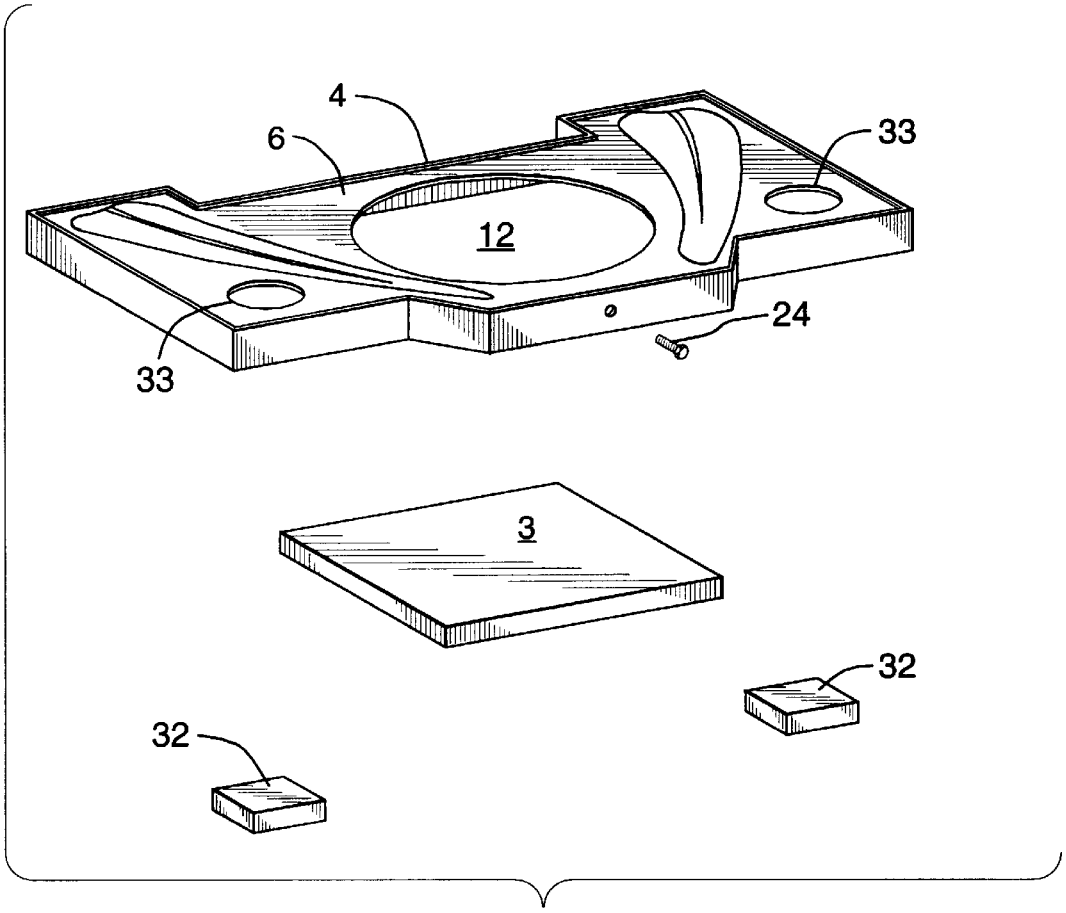
FIG. 3 is an exploded view of a first alternative memorial plaque which includes two auxiliary windows with auxiliary blocks housed under the front wall of the frame.

Also of advantage, as illustrated in FIG. 3, any number of windows 12, 33 and marker blocks 3, 32 can be provided to vary the design of the memorial plaque. As shown in FIG. 3, a relatively large marker block 3 is provided adjacent to a large central window 12 in the front face 6 of the frame 4. As an optional alternative however, auxiliary blocks 32 may also be positioned in a like manner adjacent auxiliary windows 33 in the front wall 6 of the frame 4.

On either the marker block 3 or auxiliary block 32 memorial indicia can be easily provided either by removing the blocks 3, 32 and rapidly sandblasting indicia or completely replacing the blocks 3, 32. Such memorial indicia can be selected from, for example, a sandblasted lettering, engravings, cast metal letters, moulded components or carved lettering. In the preferred embodiment however, the blocks 3 and 32 comprise a stone slab having a single polished exposed face 5. When marking indicia are to be applied, it is most economical and rapid to simply remove the blocks 3 and 32, apply a mask to the exposed surface and sandblast indicia with readily available equipment. In this manner, the marking of indicia on the blocks 3 and 32 need not be carried out by persons or in premises outside the cemetary.

Figure 4:
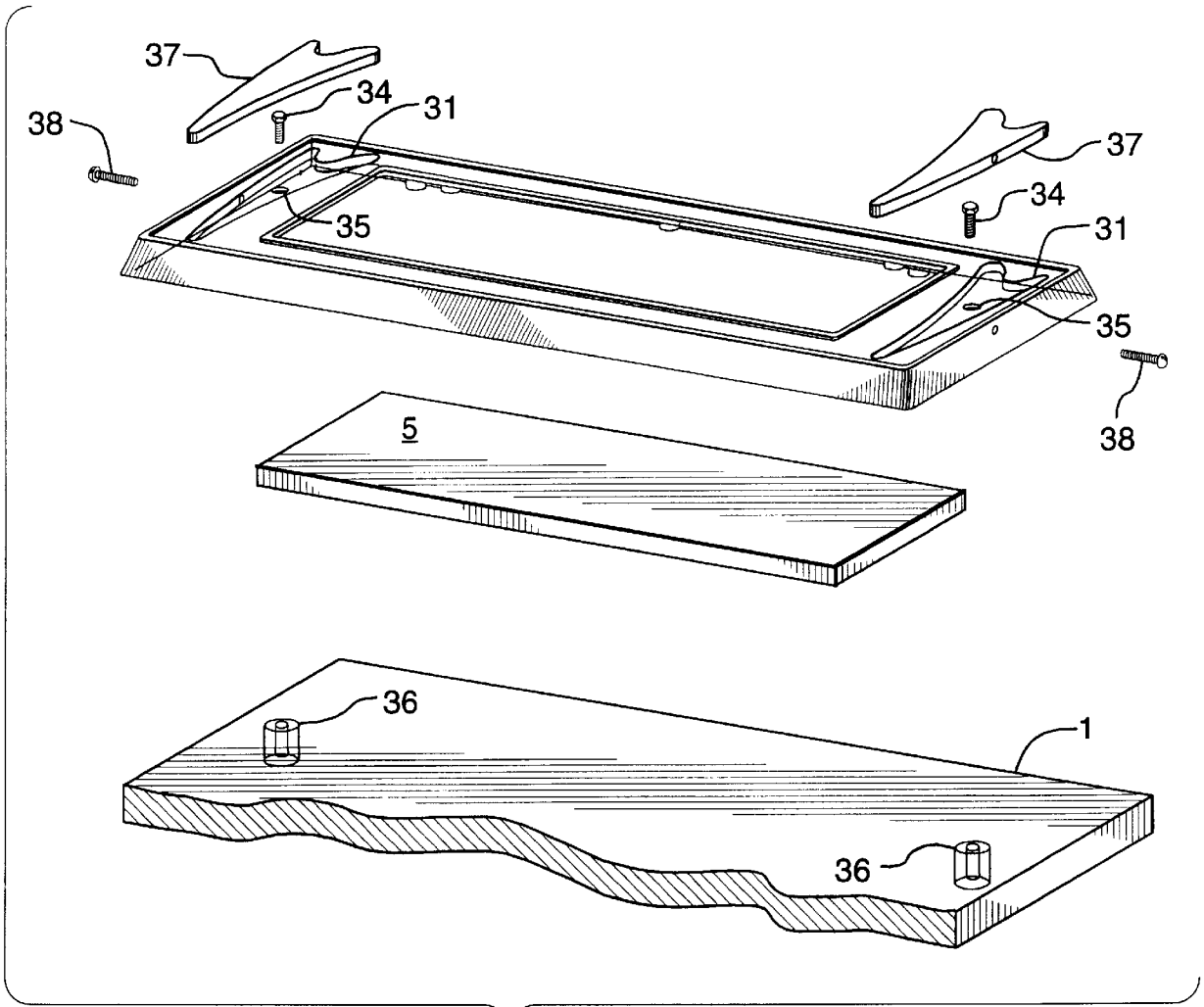
FIG. 4 is a like exploded view of a second alternative memorial plaque which has different mounting means hidden from view under removable ornamental covers and is relatively lower in height as a result since no mounting bracket and plate are required beneath the marker block.

A second alternative embodiment is illustrated in FIG. 4, which produces a thinner frame since the mounting means have been removed from behind the marking block and positioned laterally on each side of the block instead. The memorial plaque in FIG. 4 has mounting means disposed in a recessed socket 31 in the front wall 6 of the frame 4. A removable mounting bolt 34 has its shank extending through an opening 35 in the socket to engage the base 1. An outer end of the mounting bolt 34 is housed within the socket 31 and inner end is screwed into a threaded bushing 36 embedded in the base 1. A removable cover 37 is fitted in the socket 31 covering the mounting bolt 34 and connected to the frame 4 with releasable connecting set screws 38. The set screws 38 are threaded through a side wall of the frame 4 and extending laterally into the socket 31 to secure the cover 37 in the socket 31. Preferably the cover 37 includes decorative ornamentation to integrate with the design of the plaque. A variation on the same concept involves replacing the mounting bolt 34 and bushing 36 with a threaded stud secured in the base 1. In this case a nut is threaded on the stud, with the nut disposed within the socket and covered by the removable cover 37.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. A memorial plaque, adapted for detachable mounting to a forward surface of a base, the plaque comprising:

a marker block having an exposed face adapted to receive memorial indicia;

a frame having a hollow back and a front wall with peripheral rearwardly extending side walls, the peripheral side walls having a back edge with profile mating the forward surface of the base thus defining a rearwardly open cavity between the base and front wall laterally bounded by the side walls, the marker block releasably secured to the frame within the cavity with its exposed face adjacent a window in the front wall of the frame; and mounting means for releasably mounting the frame to the base.

2. A memorial plaque according to claim 1 wherein the mounting means comprise:

a recessed socket in the front wall of the frame;

a removable mounting bolt with a shank extending through an opening in the socket, an outer end housed within the socket and inner end secured to the base; and a removable cover disposed in the socket covering the mounting bolt and connected to the frame with releasable connecting means.

3. A memorial plaque according to claim 2 wherein the mounting bolt has a head at the outer end and the base includes an embedded threaded bushing within which the mounting bolt is secured.

4. A memorial plaque according to claim 2 wherein the mounting bolt comprises a threaded stud secured to the base and the mounting means include a nut threaded on the stud, the nut disposed within the socket and covered by the removable cover.

5. A memorial plaque according to claim 2 wherein the connecting means comprise a set screw threaded through a side wall of the frame and extending laterally into the socket securing the cover in the socket.

6. A memorial plaque according to claim 2 wherein the cover includes decorative ornamentation.

7. A memorial plaque according to claim 1 wherein the mounting means comprise:

a bracket mounted adjacent an upper frame side wall;

a plate with connecting means for securing the plate to the base, the plate having an upper edge adapted to suspend the frame on the bracket, and having a lower end; and locking means, disposed on a lower frame side wall and on the lower end of the plate, for releasably locking the plate and frame together.

8. A memorial plaque according to claim 7 wherein the upper edge of the flat plate is tapered, and the locking means comprise a set screw threaded in the frame and a receiving scallop in the plate.

9. A memorial plaque according to claim 1 wherein the mounting means are disposed rearward of the marker block.

10. A memorial plaque according to claim 7 wherein the plate has two upper arms.

11. A memorial plaque according to claim 1 including at least one externally mounted ornament secured to an outer surface of a wall of the frame with a fastener extending through said wall from the cavity.

12. A memorial plaque according to claim 11 wherein said outer surface of said wall includes a mating socket in which the ornament is disposed.

13. A memorial plaque according to claim 1 including an auxiliary block having an exposed face adapted to receive memorial indicia, and wherein the auxiliary block releasably secured to the frame within the cavity with its exposed face adjacent an auxiliary window in the front wall of the frame.

14. A memorial plaque according to claim 1 wherein the frame is a metal casting.

15. A memorial plaque according to claim 1 wherein the marking block is a stone slab.

16. A memorial plaque according to claim 1 wherein the memorial indicia are selected from the group consisting of: sand blasted indicia; engraved indicia; cast metal indicia; moulded indicia; and carved indicia.

* * * * *